US005387049A

United States Patent [19]

Duckett

[11] Patent Number: 5,387,049

[45] Date of Patent: Feb. 7, 1995

[54] ROADWAY BARRIER MODULE, SYSTEM AND METHOD

[75] Inventor: John W. Duckett, Carson City, Nev.

[73] Assignee: Barrier Systems, Inc., Carson City, Nev.

[21] Appl. No.: 84,002

[22] Filed: Jun. 29, 1993

[51] Int. Cl.[6] ..... E01F 15/00

[52] U.S. Cl. ..... 404/6; 256/13.1

[58] Field of Search ..... 404/6, 7, 8, 9, 10; 256/13.1; 220/646-649, 23.4, 732

[56] References Cited

U.S. PATENT DOCUMENTS

| | | | |
|---|---|---|---|
| 549,220 | 11/1895 | Townsend et al. | 220/648 X |
| 1,321,204 | 11/1919 | Haigh | 220/23.4 |
| 3,406,860 | 10/1968 | Kaufman et al. | 220/23.4 |
| 3,674,115 | 7/1972 | Young et al. | 404/6 X |
| 3,845,936 | 11/1974 | Boedecker, Jr. et al. | 256/13.1 X |
| 4,073,482 | 2/1978 | Seegmiller et al. | 256/13.1 X |
| 4,681,302 | 7/1987 | Thompson | 256/13.1 |
| 4,989,751 | 2/1991 | Gillett | 220/648 X |
| 5,011,326 | 4/1991 | Carney, III | 404/9 X |
| 5,259,524 | 11/1993 | Eckert | 220/23.4 |

FOREIGN PATENT DOCUMENTS

| | | | |
|---|---|---|---|
| 0442249 | 8/1991 | European Pat. Off. | 256/13.1 |
| 1756046 | 7/1973 | Germany | 220/23.4 |

*Primary Examiner*—Ramon S. Britts
*Assistant Examiner*—James A. Lisehora
*Attorney, Agent, or Firm*—Phillips, Moore, Lempio & Finley

[57] ABSTRACT

This invention relates to a barrier module adapted to be connected in series with additional modules to form a continuous barrier system for collectively absorbing high-impact loads thereon by a road vehicle or the like. Each module comprises a container having a chamber adapted to be filled with a shock-absorbing medium, such as water. A continuous barrier system is formed by connecting a plurality of the modules together, in tandem, by one or more cables which function to transmit impact loads substantially uniformly to the modules concurrently. In carrying forth the method of this invention, the modules for the barrier system are placed in situ on a roadway or the like prior to their being filled with water.

19 Claims, 1 Drawing Sheet

FIGURE 1
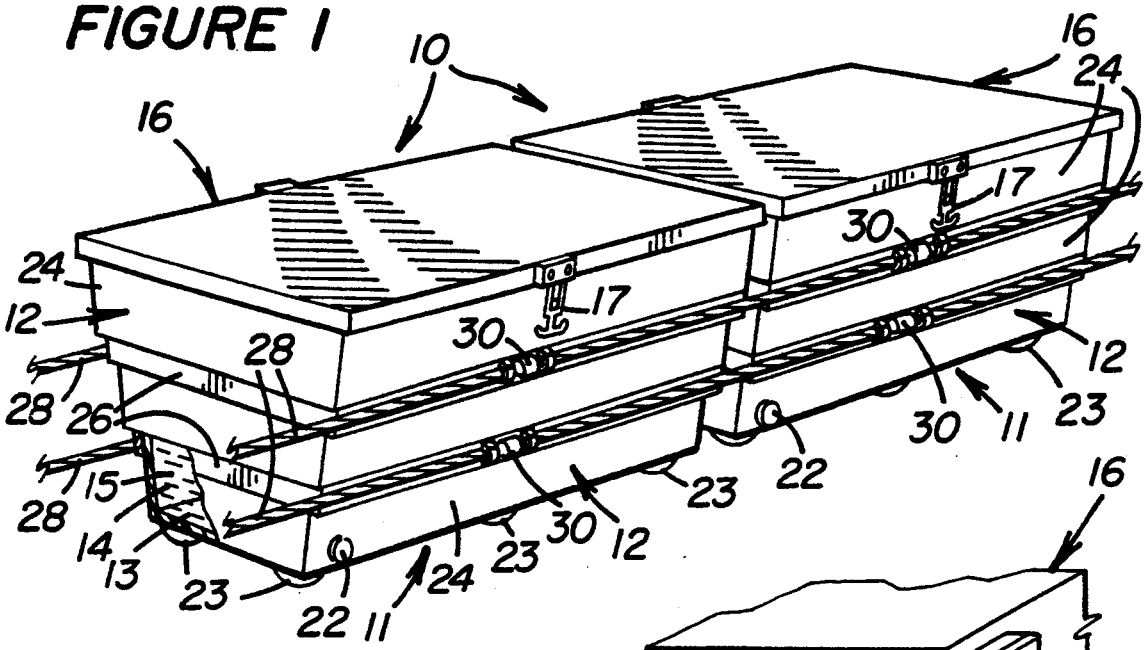
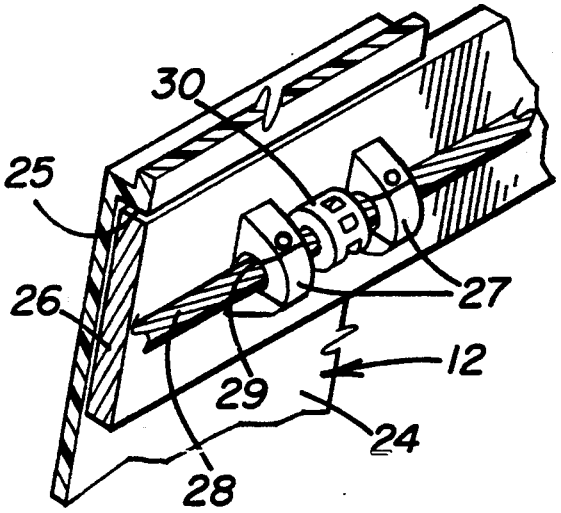
FIGURE 2
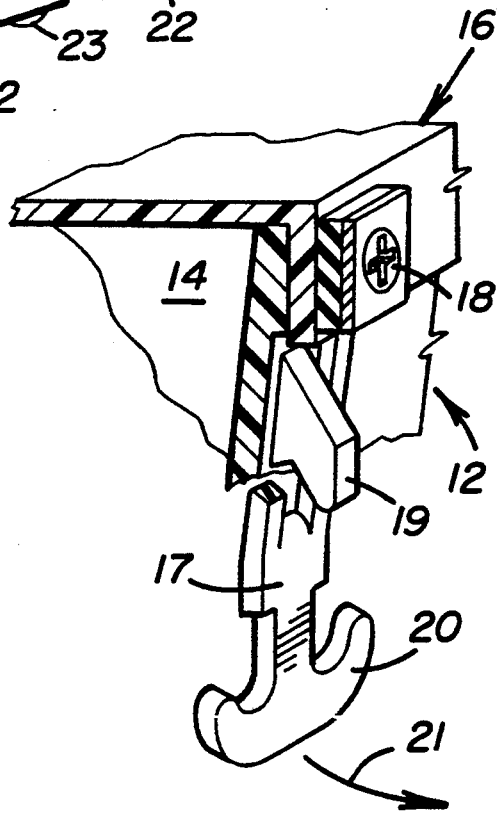
FIGURE 3
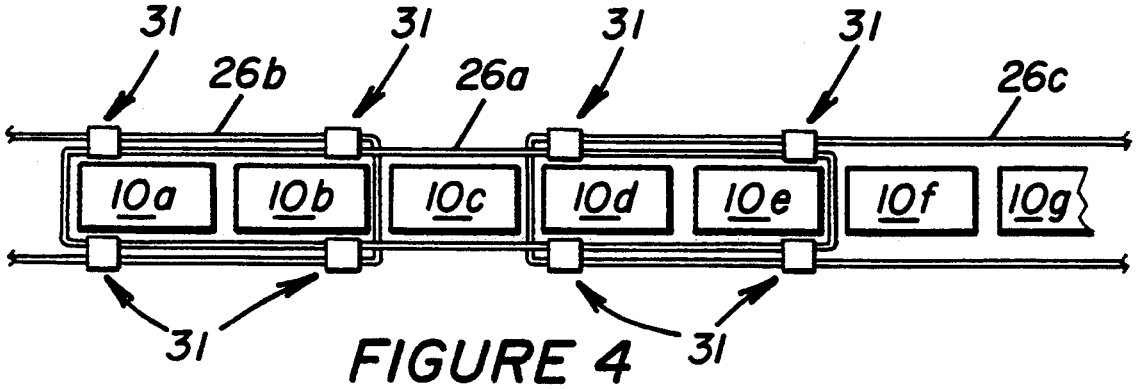
FIGURE 4

ROADWAY BARRIER MODULE, SYSTEM AND METHOD

TECHNICAL FIELD

This invention relates to a module and system adapted to be used on roadways and the like, and more particularly, to a barrier module adapted to be connected in series with other modules to form a barrier system for collectively absorbing high-impact loads imposed thereon by road vehicles.

BACKGROUND OF THE INVENTION

Various types of barrier systems for roadways are disclosed in U.S. Pat. Nos. 4,498,803, 4,500,225, 4,624,601, 4,806,044, 4,815,889, and 4,828,425. Barrier systems of this type are adapted to be placed at selected positions on a roadway or at a roadway construction site. These conventional systems comprise a plurality of steel-reinforced cement modules pivotally interconnected together at their ends.

Therefore, impact loads imparted to the system, such as by a motor vehicle, are absorbed through the pin connections located immediately adjacent to the point of impact. Further, large, conventional steel reinforced concrete modules do not, by themselves, aid in absorbing impact loads. Further, each module weighs approximately 4,500–9,000 pounds and requires a crane or the like for repair or replacement purposes when it is damaged.

SUMMARY OF THE INVENTION

The present invention provides a non-complex and economical module adapted to be connected in series with other modules to form a barrier system for collectively absorbing high-impact loads imposed thereon.

The barrier module comprises a container having upstanding sidewalls and a horizontally disposed and contiguous bottom wall defining a chamber. The chamber is adapted to be at least partially filled with a shock absorbing medium, such as water. A band circumvents the sidewalls of the container for distributing impact loads, imposed on the module, uniformly therearound.

The barrier system comprises a plurality of the modules disposed in tandem relationship relative to each other, with each module being at least substantially filled with the shock-absorbing medium. Cable means connects the modules together at their bands for distributing high-impact loads imposed on the system to at least some of the modules concurrently.

In carrying forth the method of this invention, the hollow modules are placed in tandem relationship relative to each other, either before or after they are connected together by at least one cable, and the modules are at least partially filled with the shock-absorbing medium, such as water, when in situ.

BRIEF DESCRIPTION OF THE DRAWINGS

Other objects and advantages of this invention will become apparent from the following description and accompanying drawings, wherein:

FIG. 1 is an isometric view showing a pair of barrier modules, embodying this invention, connected together by a plurality of cables;

FIG. 2 is a fragmentary sectional view illustrating connection of one of the cables to a module;

FIG. 3 is a fragmentary sectional view illustrating a latch mechanism adapted to releasably attach a cover on the module; and, FIG. 4 is a top plan view schematically illustrating an alternative system for connecting the cables to a barrier system comprising a plurality of the modules connected together in tandem.

DESCRIPTION OF THE PREFERRED EMBODIMENT

FIG. 1 illustrates a pair of barrier modules 10 connected in series to partially form a barrier system for collectively absorbing high-impact loads imposed thereon. It will become apparent that the barrier system of this invention is economical, non-complex in construction, and facilitates expeditious installation and replacement of modules. Further, the system eliminates a need for the type of hinging system disclosed in the above-referenced patents and provides for a unique concurrent distribution of high-impact loads imposed on the system to the modules of the system collectively. The modules can also be fabricated to be relatively small in comparison to other conventional modules of the road barrier type.

Each module 10 comprises an open-top container 11 having four upstanding sidewalls 12 and a horizontally disposed and contiguous bottom wall 13. The sidewalls and bottom wall of the container define a chamber 14, adapted to be at least partially filled with a shock-absorbing medium 15. A cover 16 normally closes the open top of the container and is openable to permit the chamber to be filled with the shock-absorbing medium. Container 11 and cover 16 are preferably composed of a flexible, high-impact plastic material, such as a high-density polyethylene or the like. Shock-absorbing medium 15 may constitute a liquid (e.g., water), a gel, or a granulated material, such as sand.

FIGS. 1 and 3 illustrate a latching mechanism for releasably locking cover 16 on container 11 for selectively permitting chamber 14 to be at least partially filled with shock-absorbing medium 15. In the embodiment illustrated, the latching mechanism comprises a swinging latch 17 composed of a hard rubber or plastic material having its proximal end secured to cover 16 by a plurality of fasteners 18 (one shown). In its illustrated latched or locked position holding the cover in place on the container, bifurcated latch 17 engages beneath a hook 19, secured on a sidewall of container 11.

As further shown in FIG. 3, when it is desired to remove cover 16 from the container, the workman need only grasp and pull down on a distal handle end 20 of latch 16 and swing it outwardly in the direction of arrow 21 to release the latch from hook 19. The latch has sufficient flexibility and elastomeric properties to effect the unlatching function, as described. Although a latching mechanism is shown on each lateral side of each module, it should be understood that a hinge connection could be provided on one side in lieu of one of the latches, whereby the release of the single latching mechanism would permit the cover to pivot about such hinge connection.

A standard openable drain plug 22 can be suitably mounted on a bottom of at least one of the sidewalls 12, as shown in FIG. 1, adjacent to bottom wall 13 for selectively emptying shock-absorbing medium 15 from chamber 14 of the module. A plurality of feet 23 may be secured beneath bottom wall 13 of each of the modules to provide anti-skid capabilities. The feet may be suitably spaced under the bottom wall of the module, and may be composed of any suitable material, such as rubber or a suitable plastic material.

When viewed in top plan (FIG. 4), each module is shown as being rectangular throughout its vertical height, but could be circular, elliptical or otherwise shaped when viewed in transverse cross-section. In the preferred embodiment of this invention, each sidewall 12 of container 11 tapers downwardly from cover 16 to bottom wall 13 with the cover having a larger cross-sectional area than the bottom wall. This tapered construction of the sidewalls permits containers 11 to be stacked together and within each other for storage or transport purposes, after the covers have been removed therefrom.

Each sidewall 12 preferably comprises a plurality of contiguous, stepped-down and flat wall panels 24 defining an undercut 25 (FIG. 2) at a junction of each pair of connected wall panels. A horizontally disposed and continuous band 26 (composed of steel, fiberglass, or other suitable material) has its upper end disposed within each undercut. Band 26 circumvents or surrounds sidewalls 12 of a respective container 11 for at least substantially uniformly distributing impact loads imposed on the module, as described more fully hereinafter. A pair of longitudinally-spaced multipart lugs 27 are secured to band 26 for detachably connecting a steel cable 28 to the band and module whereby the cable will be adapted to connect a series of the modules together in tandem relationship relative to each other.

As shown in FIG. 2, each lug 27 may comprise a bifurcated section having a removable wedge-shaped section releasably attached thereto by a pin, bolt or other suitable standard fastener. The cable extends through aligned eyelets 29, formed through lugs 27, and a stop member in the form of a ferrule 30 (or standard wire clamp) is crimped or otherwise suitably secured to the cable and is disposed in captured relationship between the lugs. Detachment and removal of the wedge-shaped sections of the pair of lugs will thus permit the cable to be detached from a respective band 26 and module 10.

It can be seen in FIG. 1 that when an impact load is imposed on one or more of the modules, that ferrules 30 will function as stops to delimit movement of the cable due to engagement of each ferrule with a respective lug 27. Tensioning of the cable will function to concurrently transmit impact loads through the modules collectively with bands 26 functioning to substantially uniformly apply such loads to the modules proper for shock absorption purposes. Shock absorbing medium 15 will further aid in absorbing such shock or impact loads.

It can thus be appreciated that the plurality of modules, disposed in tandem relationship relative to each other, will provide a barrier system for collectively absorbing high-impact loads imposed thereon. Flexible bands 26, flexible containers 11, and shock-absorbing medium 15 will cooperate in concert to quickly and evenly dissipate any abrupt shock loads imposed on the system by a motor vehicle or the like. In the embodiment illustrated in FIG. 1, a pair of vertically disposed cables 28 and associated bands 26 are utilized.

As shown in FIG. 4, other cable and connection arrangements could be utilized with modules 10. For example, a first group of modules 10A and 10B can be connected to a first cable 26A in the manner described above. A second cable 26B, connected to a second group of modules (not shown), can be clamped at 31 to secure the two cables together. Further, second cable 26B can be looped behind module 10B, in the manner shown. Likewise, a third cable 26C can be clamped at 31 to secure cable 26C to cable 26A. Cable 26C can be connected to a third group of modules 10F, 10G, etc., and the series repeated. The primary purpose of various cable arrangements of this type is to insure that impact loads are distributed concurrently to as many of the modules of a particular barrier system as possible.

In carrying forth the method for forming a barrier system on or adjacent to a roadway or construction site, a plurality of individual hollow modules 10 are placed in tandem relationship relative to each other. The empty modules can then be filled with the chosen shock-absorbing medium, such as water, after covers 16 have been removed from containers 11 of the modules. Each of four cables 28 is slipped sideways into open-sided eyelets 29 of respective lugs 27 (FIG. 2) and the wedge-shaped sections of the lugs are secured in place to capture ferrule 30 between the lugs. Covers 16 are then replaced and latched down.

Drain plug 22 is adapted to empty a selected module 10 for removal, replacement or repair purposes. More than one drain plug could be used for each module to expedite emptying of the shock-absorbing medium, such as water, contained therein. Removal of a particular module from the system can be expeditiously effected by simply removing the wedge-shaped sections of lugs 27 and slipping the four cables sideways to release them from eyelets 29.

Various other modifications can be made to the barrier module, system and method of this invention. For example, covers 16 could be sealed in place on containers 11 and a fill spout or the like could be provided in the cover or in one of the sidewalls of each module to fill it with the shock-absorbing medium. As suggested above, the cover could also be pivoted by a hinge connection on one side of the module with the other side being normally secured in a locked position by a single latch mechanism (FIG. 3). The size and shape of each module can be varied, depending on its use, and modules of different size and capacity could be utilized in the same continuous barrier system.

For example, the size of bottom panel 13 could be three feet wide and two feet long, with the module having a height of approximately three feet. When filled with water, constituting shock-absorbing medium 15, the module would contain approximately eight cubic feet of water for foot of length, which would equal approximately 500 pounds of weight per foot of module length. In contrast, a concrete barrier module of the type disclosed in the above-referenced patents weighs approximately 450 pounds per foot of module length.

The modules are also adapted to be manufactured inexpensively and expeditiously by conventional rotational or blow-molding methods. The number of cables 28 utilized for a particular barrier system application will largely depend on the overall size of the modules. For example, for a module having a height of four feet, three vertically spaced cables might be utilized in the manner described above. As suggested above, modules 10 preferably comprise stepped-down sidewalls 12 to facilitate their stacking together for storage and transport purposes.

I claim:

1. A barrier module adapted to be connected in series with other modules to form a continuous barrier system for collectively absorbing high-impact loads imposed thereon, said module comprising an open-top container having upstanding sidewalls and a horizontally disposed and contiguous bottom wall defining a chamber adapted to be at least partially filled with a shock-absorbing medium, the sidewalls and bottom wall of said container being composed of a flexible, high-impact plastic material, at least one horizontally disposed continuous band means completely surrounding said sidewalls for at least substantially uniformly distributing said impact loads to and around said module, and lug means secured to said band means for detachably connecting a cable to said band means and module whereby said cable will be adapted to connect a series of said modules together in tandem relationship relative to each other.

2. The module of claim 1 further comprising cover means for normally closing the open-top of said container and openable to permit said chamber to be at least partially filled with said shock-absorbing medium, and latch means for releasably locking said cover means to said container.

3. The module of claim 2 wherein said module, when viewed in plan, is rectangular throughout its vertical height.

4. The module of claim 3 wherein said sidewalls taper downwardly from said cover means to said bottom wall so that said cover means has a larger cross-sectional area than said bottom wall to permit stacking of a plurality of modules together and within each other.

5. The module of claim 4 wherein each of said sidewalls comprises a plurality of contiguous, stepped-down and flat wall panels defining an undercut at a junction of each pair of connected wall panels.

6. The module of claim 1 further comprising openable drain plug means, adjacent to a bottom of at least one of said sidewalls and adjacent to said bottom wall, for selectively emptying said shock-absorbing medium from said chamber.

7. The module of claim 1 wherein said chamber is at least substantially filled with a shock-absorbing medium for absorbing high-impact loads imposed on a sidewall of said module by a road vehicle.

8. The module of claim 7 wherein said shock-absorbing medium is a liquid, a gel, or a granulated material.

9. The module of claim 8 wherein said shock absorbing medium constitutes water.

10. The module of claim 8 wherein said shock absorbing medium constitutes sand.

11. The module of claim 1 wherein said lug means comprises a pair of longitudinally spaced lugs secured to said band means and having aligned eyelets formed therethrough adapted to receive said cable.

12. The module of claim 11 further comprising a continuous cable disposed in the eyelets of said lugs and a stop member secured to said cable and disposed between said lugs.

13. A continuous barrier system for collectively absorbing high-impact loads imposed thereon comprising a plurality of modules disposed in separated, tandem relationship relative to each other, each of said modules defining a chamber therein, a shock absorbing medium at least substantially filling said chamber for absorbing said high-impact loads, cable means connecting said modules together for distributing said high-impact loads to at least some of said modules concurrently, each said module comprising band means surrounding sidewalls thereof for at least substantially uniformly distributing said high impact loads thereto and therearound and wherein said cable means is connected to said band means, and lug means secured to each said band means for detachably connecting said cable means to said band means and module whereby said cable means will be adapted to connect said plurality of modules together in tandem relationship relative to each other.

14. The barrier system of claim 13 wherein a pair of vertically spaced cable means are connected to each of said modules.

15. The barrier system of claim 13 wherein said cable means comprises at least one first cable connecting a first group of said modules together and a second cable connecting a second group of said modules together, said first and second cables being secured together.

16. The barrier system of claim 15 wherein said second cable loops around at least two of the modules of said first group of modules.

17. A method for forming a continuous barrier system comprising securing a band around each individual hollow module of a plurality of modules, securing lug means to said band for detachably connecting a cable to said band and module whereby said cable will be adapted to connect a series of said modules together in tandem relationship relative to each other, placing said plurality of individual hollow modules in tandem relationship relative to each other, connecting the bands of said modules together with at least one cable, and at least substantially filling each of said modules with a shock-absorbing medium.

18. A barrier module adapted to be connected in series with other modules to form a continuous barrier system for collectively absorbing high-impact loads imposed thereon, said module comprising an open-top container having cover means for normally closing the container, said container also having upstanding sidewalls and a horizontally disposed and contiguous bottom wall defining a chamber adapted to be at least partially filled with a shock-absorbing medium, the sidewalls and bottom wall of said container being composed of a flexible, high-impact plastic material, said module, when viewed in plan, being rectangular throughout its vertical height and wherein said sidewalls taper downwardly from said cover means to said bottom wall so that said cover means has a larger cross-sectional area than said bottom wall to permit stacking of a plurality of modules together and within each other, each of said sidewalls comprising a plurality of contiguous, stepped-down and flat wall panels defining an undercut at a junction of each pair of connected wall panels.

19. A continuous barrier system for collectively absorbing high-impact loads imposed thereon comprising a plurality of modules disposed in tandem relationship relative to each other, each of said modules defining a chamber therein, a shock-absorbing medium at least substantially filling said chamber for absorbing said high-impact loads, and cable means connecting said modules together for distributing said high-impact loads to at least some of said modules concurrently, said cable means comprising at least one first cable connecting a first group of said modules together and a second cable connecting a second group of said modules together, said first and second cables being secured together and wherein said second cable loops around at least two of the modules of said first group of modules.

* * * * *